US010775062B2

(12) United States Patent
Wang et al.

(10) Patent No.: US 10,775,062 B2
(45) Date of Patent: Sep. 15, 2020

(54) METHOD FOR CLEANING AIR CONDITIONER INDOOR UNIT AND OUTDOOR UNIT

(71) Applicant: Qingdao Haier Air Conditioner General Corp., Ltd., Shandong (CN)

(72) Inventors: Fei Wang, Shandong (CN); Hongjin Wu, Shandong (CN); Yu Fu, Shandong (CN); Mingjie Zhang, Shandong (CN); Zeyuan Bai, Shandong (CN)

(73) Assignee: Qingdao Haier Air Conditioner General Corp., Ltd., Shandong (CN)

( * ) Notice: Subject to any disclaimer, the term of this patent is extended or adjusted under 35 U.S.C. 154(b) by 70 days.

(21) Appl. No.: 15/978,068

(22) Filed: May 11, 2018

(65) Prior Publication Data

US 2018/0259208 A1 Sep. 13, 2018

Related U.S. Application Data

(63) Continuation-in-part of application No. PCT/CN2016/108394, filed on Feb. 16, 2012.

(30) Foreign Application Priority Data

Nov. 11, 2016 (CN) ..... 2016 1 1019603

(51) Int. Cl.
*F24F 11/41* (2018.01)
*F25B 47/02* (2006.01)
(Continued)

(52) U.S. Cl.
CPC ..... *F24F 11/41* (2018.01); *F24F 1/60* (2013.01); *F24F 11/70* (2018.01); *F24F 11/89* (2018.01);
(Continued)

(58) Field of Classification Search
CPC .. F24F 11/41; F24F 11/42; F24F 11/43; F24F 11/70; F24F 1/60; F24F 13/22; F24F 2140/10; F24F 2221/22
See application file for complete search history.

(56) References Cited

U.S. PATENT DOCUMENTS

2008/0196418 A1 8/2008 Lifson et al.
2009/0277196 A1 11/2009 Gambiana et al.

FOREIGN PATENT DOCUMENTS

CN 1702406 A 11/2005
CN 101256061 A 9/2008
(Continued)

OTHER PUBLICATIONS

CN105605742 translation.*
(Continued)

*Primary Examiner* — Elizabeth J Martin
(74) *Attorney, Agent, or Firm* — Marshall, Gerstein & Borun LLP

(57) ABSTRACT

A method for cleaning an air conditioner indoor unit and outdoor unit includes controlling a heat exchanger to enter a self-cleaning mode, adjusting an operating frequency of an air conditioner, an opening of a throttling device, and a corresponding fan speed of the heat exchanger, and maintaining an evaporating temperature of the heat exchanger within a present range to enable a frost process on a surface of the heat exchanger. When a differential pressure of the air conditioner meets a preset condition, a four-way valve changes a direction, switching defrosting to indoor and outdoor heat exchangers. When the differential pressure does not meet the preset condition, the air conditioner is adjusted to meet the preset condition and the four-way valve direction is changed to perform a defrosting switching to the indoor and outdoor heat exchangers.

12 Claims, 3 Drawing Sheets

(51) Int. Cl.

| | |
|---|---|
| ***F24F 11/89*** | (2018.01) |
| ***F24F 11/70*** | (2018.01) |
| ***F24F 1/60*** | (2011.01) |
| ***F24F 13/22*** | (2006.01) |
| ***F24F 140/12*** | (2018.01) |
| ***F24F 140/10*** | (2018.01) |

(52) U.S. Cl.

CPC ..... *F24F 13/222* (2013.01); *F25B 47/025* (2013.01); *F24F 2140/10* (2018.01); *F24F 2140/12* (2018.01); *F24F 2221/22* (2013.01); *F24F 2221/225* (2013.01)

(56) References Cited

FOREIGN PATENT DOCUMENTS

| | | | |
|---|---|---|---|
| CN | 203454346 | U | 2/2014 |
| CN | 104390669 | A | 3/2015 |
| CN | 104422064 | A | 3/2015 |
| CN | 104833052 | A | 8/2015 |
| CN | 104848507 | A | 8/2015 |
| CN | 104848738 | A | 8/2015 |
| CN | 104949261 | A | 9/2015 |
| CN | 105202724 | A | 12/2015 |
| CN | 105465979 | A | 4/2016 |
| CN | 105486164 | A | 4/2016 |
| CN | 105605742 | A | 5/2016 |
| JP | 2009092353 | A | 4/2009 |
| JP | 2010014288 | A | 1/2010 |
| JP | 2010151364 | A | 7/2010 |
| JP | 2012052679 | A | 3/2012 |
| JP | 2014159954 | A | 9/2014 |
| KR | 2001-0089909 | A | 10/2001 |
| KR | 20110097264 | A | 8/2011 |

OTHER PUBLICATIONS

Office Action from Japanese Application No. 2017-556728 dated Nov. 29, 2018.

Office Action from Japanese Application No. 2017-556728 dated Apr. 25, 2019.

Office Action from Russian Application No. 2017111051/12 dated Apr. 25, 2018.

Search Report from Russian Application No. 2017111051/12 dated Apr. 25, 2018.

Office Action from Chinese Application No. 201611019603.1 dated Aug. 22, 2018.

Search Report from European Application No. 16840287.3 dated Sep. 25, 2018.

Office Action from New Zealand Application No. 738566 dated Oct. 23, 2019.

International Search Report and Written Opinion from PCT/CN2016/108394 dated Aug. 8, 2017.

* cited by examiner

METHOD FOR CLEANING AIR CONDITIONER INDOOR UNIT AND OUTDOOR UNIT

The present application is a Continuation-in-Part of International Application No. PCT/CN2016/108394, filed Dec. 2, 2016, designating the United States, and claiming the benefit of Chinese Patent Application No. 201611019603.1, filed with the Chinese Patent Office on Nov. 11, 2016 and entitled "method for cleaning an air conditioner indoor unit and outdoor unit", which are hereby incorporated by reference in their entireties.

TECHNICAL FIELD

The present invention relates to the technical field of air conditioners, and in particular to a method for cleaning an air conditioner indoor unit and outdoor unit.

BACKGROUND

In order to ensure full heat exchange of an air conditioner, a fin of a heat exchanger of the air conditioner often is designed as a plurality layers of compact sheets, where a gap between the sheets is only 1 to 2 mm, and various embossing or fractures are added to the fin of a heat exchanger so as to increase a heat exchange area. When the air conditioner is operating, a lot of air flows through the heat exchanger to perform a heat exchange. Various dusts and impurities in the air adhere to the heat exchanger; this affects effects of the heat exchanger, breeds bacterium easily, brings a peculiar smell to the air conditioner, and even affects user health. At this time, the heat exchanger of the air conditioner needs to be cleaned.

At present, an outdoor unit is cleaned in a long time interval or is never cleaned. While being cleaned manually, the heat exchanger is difficult to be cleaned because the heat exchanger is close to a wall. As a result, the heat exchanger is not completely cleaned. Cleaning the heat exchanger by extending a foreign object may cause sheets of the fin to fall down, so as to further affect heat exchanging effects of the heat exchanger, and shorten service life thereof.

In the prior art, the heat exchanger is cleaned by using manners of frosting and defrosting the heat exchanger. However, when self cleaning to an indoor heat exchanger or an outdoor heat exchanger is switched, an evaporating temperature and an evaporating pressure during a self cleaning process are low. Therefore, a difference between a high pressure and a low pressure of the air conditioner is excessive, and a compressor is shocked during a process of switching a four-way valve. As a result, operation of the air conditioner is unstable.

SUMMARY

An objective of the present invention is providing a method for cleaning an air conditioner indoor unit and outdoor unit. The method is capable of avoiding an excessive difference between a high pressure and a low pressure of an air conditioner during a process of switching self cleaning to indoor and outdoor heat exchangers of the air conditioner, thereby ensuring a stable and reliable operation of the air conditioner.

According to an aspect of the present invention, a method for cleaning an air conditioner indoor unit and outdoor unit is provided, including:

controlling a to-be-cleaned heat exchanger to enter a self-cleaning mode;

adjusting an operating frequency of an air conditioner, an opening of a throttling device, and a corresponding fan speed of the to-be-cleaned heat exchanger, and maintaining an evaporating temperature of the to-be-cleaned heat exchanger within a present range, so as to enable a surface of the to-be-cleaned heat exchanger to frost;

keeping the to-be-cleaned heat exchanger frosting for a time of t1;

detecting whether a differential pressure between a high pressure and a low pressure of the air conditioner meets a preset condition;

when the differential pressure between the high pressure and the low pressure of the air conditioner meets the preset condition, controlling a four-way valve to change a direction, so as to perform a defrosting switching to indoor and outdoor heat exchangers; and when the differential pressure between the high pressure and the low pressure of the air conditioner does not meet the preset condition, adjusting an operating parameter of the air conditioner to enable the differential pressure between the high pressure and the low pressure of the air conditioner to meet the preset condition, and then controlling the four-way valve to change the direction, so as to perform a defrosting switching to the indoor and outdoor heat exchangers.

Preferably, when the following conditions are satisfied, the differential pressure between the high pressure and the low pressure of the air conditioner is determined to meet the preset condition:

$|Ti-To| \leq B$, where a value of $B$ is 20-40; or $Pi/Po \leq A (Pi > Po)$; or $Po/Pi \leq A$ (when $Po > Pi$), where Ti is the evaporating temperature, To is a condensing temperature, Pi is a corresponding saturated evaporating pressure of Ti, Po is a corresponding saturated condensing pressure of To, and a value of A is between 1.1-3.

Preferably, when the differential pressure between the high pressure and the low pressure of the air conditioner does not meet the preset condition, the step of the adjusting an operating parameter of the air conditioner to enable the differential pressure between the high pressure and the low pressure of the air conditioner to meet the preset condition includes at least one of the following:

lifting speeds of indoor and outdoor fans, and increasing indoor and outdoor air volumes;

decreasing a frequency of a compressor to H1, and keeping for a time of t2; and adjusting the opening of the throttling device to the maximum.

Preferably, when performing self cleaning to the air conditioner, if the air conditioner is in an operating mode of cooling or dehumidifying before the self cleaning is started, self cleaning to the indoor heat exchanger is first performed; and if the air conditioner is in an operating mode of heating before the self cleaning is started, self cleaning to the outdoor heat exchanger is first performed.

Preferably, the step of the enabling a surface of the to-be-cleaned heat exchanger to frost includes: after the to-be-cleaned heat exchanger enters a frosting mode, controlling a corresponding fan of the to-be-cleaned heat exchanger to be started for a time of t3, so as to enable the surface of the to-be-cleaned heat exchanger to be covered with a water film; and then turning off the fan.

Preferably, a starting time of the fan is calculated according to the following formula:

$$t = \frac{Q}{k2 * m}$$

where Q is a latent cooling quantity of the to-be-cleaned heat exchanger at a starting stage of the corresponding fan, k2 is latent heat of vaporization at an air outlet temperature, and m is a water volume for the to-be-cleaned heat exchanger to be covered with the water film.

Preferably, the latent cooling quantity Q is calculated according to the following formula:

$$Q=k2*q*(W1-W2)/V(1+W3)$$

where q is an air volume of a detected point of the corresponding fan of the to-be-cleaned heat exchanger, W1 is an air inlet absolute humidity, W2 is an air outlet absolute humidity, W3 is an air outlet relative humidity, V is a specific volume of humid air at the air outlet.

Preferably, the water volume m is calculated according to the following formula:

$$m=\rho*V1=\rho*L*W*H*n*2*h*k1$$

where L is a length of a radiator heatsink, W is a width of the radiator heatsink, H is a height of the radiator heatsink, n is a quantity of the radiator heatsink, h1 is a thickness of the water film, k1 is a margin constant, and ρ is a density of water.

Preferably, the air volume q of the detected point of the fan is calculated according to the following formula:

$$q=k3*N+C,$$

where K3 and C are constant parameters of designs of different models and air outlets, and N is a corresponding fan speed of the to-be-cleaned heat exchanger.

Preferably, after the keeping the to-be-cleaned heat exchanger frosting for a time of t1, and before the detecting whether a differential pressure between a high pressure and a low pressure of the air conditioner meets a preset condition, the method for cleaning an air conditioner indoor unit and outdoor unit further includes:

stopping operation of the compressor; and keeping the corresponding fan of the to-be-cleaned heat exchanger to operate, so as to perform a defrosting processing.

Preferably, after the keeping the to-be-cleaned heat exchanger frosting for a time of t1, and before the detecting whether a differential pressure between a high pressure and a low pressure of the air conditioner meets a preset condition, the method for cleaning an air conditioner indoor unit and outdoor unit further includes:

stopping operation of the compressor; and controlling the corresponding fan of the to-be-cleaned heat exchanger to stop operating, and after maintaining for a time of t4, starting the corresponding fan of the to-be-cleaned heat exchanger to operate, so as to enter the defrosting processing.

According to another aspect of the present invention, an air conditioner is provided, comprising a memory and one or more processors, wherein the memory stores therein computer readable program codes, and the one or more processors are configured to execute the computer readable program codes:

to control a to-be-cleaned heat exchanger to enter a self-cleaning mode;

to adjust an operating frequency of an air conditioner, an opening of a throttling device, and a corresponding fan speed of the to-be-cleaned heat exchanger, and to maintain an evaporating temperature of the to-be-cleaned heat exchanger within a present range, so as to enable a surface of the to-be-cleaned heat exchanger to frost;

to keep the to-be-cleaned heat exchanger frosting for a time of t1;

to detect whether a differential pressure between a high pressure and a low pressure of the air conditioner meets a preset condition;

when the differential pressure between the high pressure and the low pressure of the air conditioner meets the preset condition, to control a four-way valve to change a direction, so as to perform a defrosting switching to indoor and outdoor heat exchangers; and when the differential pressure between the high pressure and the low pressure of the air conditioner does not meet the preset condition, to adjust an operating parameter of the air conditioner to enable the differential pressure between the high pressure and the low pressure of the air conditioner to meet the preset condition, and then to control the four-way valve to change the direction, so as to perform a defrosting switching to the indoor and outdoor heat exchangers.

According to another aspect of the present invention, a method for cleaning an air conditioner indoor unit and outdoor unit is provided, including:

controlling, by a processor of a air conditioner, a to-be-cleaned heat exchanger of the air conditioner to enter a self-cleaning mode;

adjusting, by the processor, an operating frequency of an air conditioner, an opening of a throttling device, and a corresponding fan speed of the to-be-cleaned heat exchanger, and maintaining, by the processor, an evaporating temperature of the to-be-cleaned heat exchanger within a present range, so as to enable a surface of the to-be-cleaned heat exchanger to frost;

keeping, by the processor, the to-be-cleaned heat exchanger frosting for a time of t1;

detecting, by the processor, whether a differential pressure between a high pressure and a low pressure of the air conditioner meets a preset condition;

when the differential pressure between the high pressure and the low pressure of the air conditioner meets the preset condition, controlling, by the processor, a four-way valve to change a direction, so as to perform a defrosting switching to indoor and outdoor heat exchangers; and when the differential pressure between the high pressure and the low pressure of the air conditioner does not meet the preset condition, adjusting, by the processor, an operating parameter of the air conditioner to enable the differential pressure between the high pressure and the low pressure of the air conditioner to meet the preset condition, and then controlling, by the processor, the four-way valve to change the direction, so as to perform a defrosting switching to the indoor and outdoor heat exchangers.

The method for cleaning an air conditioner indoor unit and outdoor unit of the present embodiments may adjust the operating frequency of the air conditioner, the opening of the throttling device, and the corresponding fan speed of the to-be-cleaned heat exchanger, so as to make sure that a heat exchanger in a cleaning state can frost quickly and evenly, thereby improving an defrosting efficiency of the heat exchanger. Meanwhile, the method may remove, through surface frosting of the heat exchanger, dusts from the surface of the heat exchanger, and then clean through defrosting; this may improve cleaning effects on the heat exchanger. At the same time, during a defrosting process, a direction change of the four-way valve may be controlled by detecting whether the differential pressure between the high pressure and the low pressure of the air conditioner meets the preset condition. Therefore, the method is capable of avoiding a great shock to the compressor because of an excessive difference between the high pressure and the low pressure of the air conditioner during a process of switching self cleaning to the indoor and outdoor heat exchangers of the air conditioner, thereby ensuring a stable and reliable operation of the air conditioner.

It should be understood that the above general description and the following detailed description are merely for illustration and explanatory purposes, and do not limit the present invention.

BRIEF DESCRIPTION OF THE DRAWINGS

The accompanying drawing, which is incorporated in and constitutes a part of this specification, illustrates embodiments consistent with the present invention and, together with the description, serves to explain the principles of the present invention.

DETAILED DESCRIPTION

The following description and accompanying drawing fully illustrate the specific implementation solutions of the present invention, so that a person skilled in the art can practice the same. Other implementation solutions may include variations to the structure, logic, electricity, process, and others. The embodiments represent possible variations only. Unless being explicitly requested, individual parts and functions are optional, and an operation order may be changed. Parts and features of some implementation solutions may be included in or replace the parts and features of other implementation solutions. The scope of the implementation solutions of the present invention includes the entire scope of the claims, and all obtainable equivalents of the claims. Herein, the implementation solutions may be individually or wholly represented by a term "invention"; this is for convenience only. Moreover, if more than one invention is actually disclosed, it is not intended to automatically limit the scope of the application to any individual invention or conception of the invention. In the specification, relational terms such as first and second are used only to differentiate an entity or operation from another entity or operation, and do not require or imply that any actual relationship or sequence exists between these entities or operations. Moreover, the terms "include", "comprise", or any variants thereof are intended to cover a non-exclusive inclusion. Therefore, in the context of a process, method, or device that includes a series of elements, the process, method, or device not only includes such elements, but also includes other elements not specified expressly, or may include inherent elements of the process, method, or device. Unless otherwise specified, an element limited by "include a/an . . . " does not exclude other same elements existing in the process, the method, or the device that includes the element. The embodiments in the specification are all described in a progressive manner, for same or similar parts in the embodiments, refer to these embodiments, and each embodiment focuses on a difference from other embodiments. The method and product disclosed in the embodiments correspond to the method disclosed in the embodiments and therefore are only briefly described, and reference may be made to the description to the method for the associated part.

Figure 1:
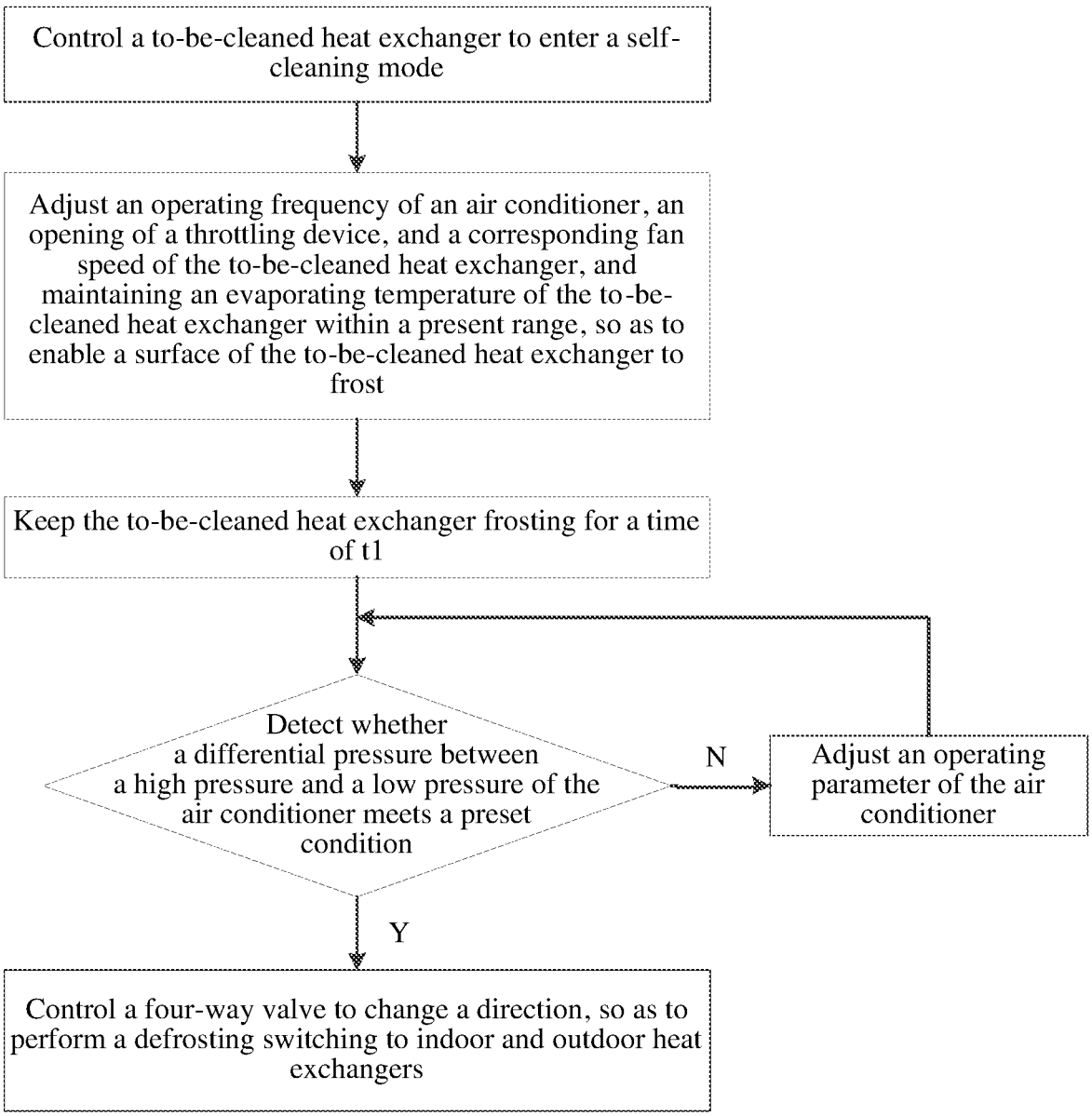
FIG. 1 is a schematic flowchart of a method for cleaning an air conditioner indoor unit and outdoor unit according to an embodiment of the present invention.

With reference to FIG. 1, according to the embodiments of the present invention, a method for cleaning an air conditioner indoor unit and outdoor unit includes:

Controlling a to-be-cleaned heat exchanger to enter a self-cleaning mode;

Adjusting an operating frequency of an air conditioner, an opening of a throttling device, and a corresponding fan speed of the to-be-cleaned heat exchanger, and maintaining an evaporating temperature of the to-be-cleaned heat exchanger within a present range, so as to enable a surface of the to-be-cleaned heat exchanger to frost;

Keeping the to-be-cleaned heat exchanger frosting for a time of t1;

Detecting whether a differential pressure between a high pressure and a low pressure of the air conditioner meets a preset condition;

when the differential pressure between the high pressure and the low pressure of the air conditioner meets the preset condition, controlling a four-way valve to change a direction, so as to perform a defrosting switching to indoor and outdoor heat exchangers; and when the differential pressure between the high pressure and the low pressure of the air conditioner does not meet the preset condition, adjusting an operating parameter of the air conditioner to enable the differential pressure between the high pressure and the low pressure of the air conditioner to meet the preset condition, and then controlling the four-way valve to change the direction, so as to perform a defrosting switching to the indoor and outdoor heat exchangers. If the t1 herein is, for example, 8 min, a value range thereof may be between 5 to 15 min.

The method for cleaning an air conditioner indoor unit and outdoor unit of the present invention, may adjust the operating frequency of the air conditioner, the opening of the throttling device, and the corresponding fan speed of the to-be-cleaned heat exchanger, so as to make sure that a heat exchanger in a cleaning state can frost quickly and evenly, thereby improving an defrosting efficiency of the heat exchanger. Meanwhile, the method may remove, through surface frosting of the heat exchanger, dusts from the surface of the heat exchanger, and then clean through defrosting; this may improve cleaning effects on the heat exchanger. At the same time, during a defrosting process, a direction change of the four-way valve may be controlled by detecting whether the differential pressure between the high pressure and the low pressure of the air conditioner meets the preset condition. Therefore, the method is capable of avoiding a great shock to the compressor because of an excessive difference between the high pressure and the low pressure of the air conditioner during a process of switching self cleaning to the indoor and outdoor heat exchangers of the air conditioner, thereby ensuring a stable and reliable operation of the air conditioner.

The air conditioner receives a signal of entering self cleaning, where the signal may be an accumulated interval time, or a forced entry signal. After entering the self-cleaning mode, the evaporating temperature of the to-be-cleaned heat exchanger is maintained at a constant value or range by adjusting a frequency of an air conditioner, an opening of a throttling valve, and the corresponding fan speed of the to-be-cleaned heat exchanger. Within this range, a surface of the to-be-cleaned heat exchanger is enabled to frost quickly. After a self cleaning cycle of the to-be-cleaned heat exchanger is reached, whether the differential pressure between the high pressure and the low pressure of the air conditioner meets a differential pressure allowed by the direction change of the four-way valve is determined. When the differential pressure between the high pressure and the low pressure of the air conditioner meets the differential pressure allowed by the direction change of the four-way valve, the four-way valve is controlled to change a direction, so as to perform a defrosting switching to the indoor and outdoor heat exchangers; and when the differential pressure between the high pressure and the low pressure of the air conditioner does not meet the differential pressure allowed by the direction change of the four-way valve, the operating parameter of the air conditioner is adjusted to enable the differential pressure between the high pressure and the low pressure of the air conditioner to meet the differential pressure allowed by the direction change of the four-way valve, and then the four-way valve is controlled to change the direction, so as to perform a defrosting switching to the indoor and outdoor heat exchangers. Because the four-way valve of the air conditioner changes the direction, frosts of the frosted heat exchanger are quickly melted into water, thereby achieving an object of cleaning the heat exchanger. After the four-way valve changes the direction, the entire machine enters a process of cleaning another heat exchanger.

According to the method for cleaning an air conditioner indoor unit and outdoor unit of the present invention, when the following conditions are satisfied, the differential pressure between the high pressure and the low pressure of the air conditioner is determined to meet the preset condition:

$|Ti-To| \leq B$, where a value of $B$ is 20-40; or $Pi/Po \leq A (Pi>Po)$; or $Po/Pi \leq A$ (when $Pi>Po$), where Ti is the evaporating temperature, To is a condensing temperature, Pi is a corresponding saturated evaporating pressure of Ti, Po is a corresponding saturated condensing pressure of To, and a value of A is between 1.1-3; and a value of B is preferably 30, and the value of A is preferably 2.

When the differential pressure between the high pressure and the low pressure of the air conditioner does not meet the foregoing preset condition, the step of the adjusting an operating parameter of the air conditioner to enable the differential pressure between the high pressure and the low pressure of the air conditioner to meet the foregoing preset condition includes at least one of the following:

lifting speeds of indoor and outdoor fans, and increasing indoor and outdoor air volumes;

decreasing a frequency of a compressor to H1, and keeping for a time of t2; and adjusting the opening of the throttling device to the maximum.

H1 is a minimum operating frequency of the compressor which enables the differential pressure between the high pressure and the low pressure of the air conditioner to meet the foregoing preset condition; t2 is a time keeping the compressor at this operating frequency and being able to melt frosts of to-be-cleaned heat exchanger; and t2 is, for example, 5 min.

During a process of adjusting the differential pressure between the high pressure and the low pressure of the air conditioner, only one of the foregoing steps may be adjusted to detect whether the differential pressure between the high pressure and the low pressure of the air conditioner meets the foregoing preset condition. If not, any one step of the other steps may further be adjusted, so as to detect whether the differential pressure between the high pressure and the low pressure of the air conditioner meets the foregoing preset condition. If not, a remaining step may further be adjusted to detect whether the differential pressure between the high pressure and the low pressure of the air conditioner meets the foregoing preset condition. Any two of the foregoing three steps may also be adjusted at the same time, or the foregoing three steps may also be adjusted at the same time, until the differential pressure between the high pressure and the low pressure of the air conditioner meets the foregoing preset condition.

Regarding the foregoing three steps of adjusting the operating parameter of the air conditioner, the differential pressure between the high pressure and the low pressure of the air conditioner may be enabled to meet the foregoing preset condition by adjusting any one step; and a time for the differential pressure between the high pressure and the low pressure of the air conditioner to meet the foregoing preset condition may be shortened by adjusting a plurality of the steps.

According to the method for cleaning an air conditioner indoor unit and outdoor unit of the present invention, when performing self cleaning to the air conditioner, if the air conditioner is in an operating mode of cooling or dehumidifying before the self cleaning is started, self cleaning to the indoor heat exchanger is first performed; and if the air conditioner is in an operating mode of heating before the self cleaning is started, self cleaning to the outdoor heat exchanger is first performed, so as to shorten the cleaning time. When the air conditioner is in an operating mode of cooling or dehumidifying, the indoor heat exchanger per se is used as an evaporator, is in a heat-absorbing state, and a surface temperature thereof is low. Therefore, only a smaller cooling capacity is needed for directly performing the self cleaning to the indoor heat exchanger. Similarly, when the air conditioner is in an operating mode of heating, the outdoor heat exchanger is used as an evaporator, absorbs external energy, and a surface temperature thereof is low. When performing the self cleaning to the outdoor heat exchanger, only a smaller cooling capacity is consumed. Therefore, a self-cleaning order of the heat exchangers may be rationally ranged by using operating features of the air conditioner, so that the self cleaning of the heat exchangers can be more energy-saving and efficient.

According to the method for cleaning an air conditioner indoor unit and outdoor unit of the present invention, the step of the enabling a surface of the to-be-cleaned heat exchanger to frost includes: after the to-be-cleaned heat exchanger enters a frosting mode, controlling a corresponding fan of the to-be-cleaned heat exchanger to be started for a time of t3, so as to enable the surface of the to-be-cleaned heat exchanger to be covered with a water film; and then turning off the fan.

A starting time of the fan is calculated according to the following formula:

$t=Q/(k2*m)$, where Q is a latent cooling quantity of the to-be-cleaned heat exchanger at a starting stage of the corresponding fan, k2 is latent heat of vaporization at an air outlet temperature, and m is a water volume for the to-be-cleaned heat exchanger to be covered with the water film.

The latent cooling quantity Q is calculated according to the following formula:

$$Q=k2*q*(W1-W2)/V(1+W3)$$

where q is an air volume of a detected point of the corresponding fan of the to-be-cleaned heat exchanger, W1 is an air inlet absolute humidity, W2 is an air outlet absolute humidity, W3 is an air outlet relative humidity, V is a specific volume of humid air at the air outlet.

W1 is the air inlet absolute humidity at a fan side corresponding to the to-be-cleaned heat exchanger; W2 is the air outlet absolute humidity at the fan side corresponding to the to-be-cleaned heat exchanger; W3 is the air outlet relative humidity at the fan side corresponding to the to-be-cleaned heat exchanger; and V is the specific volume of humid air at the air outlet at the fan side corresponding to the to-be-cleaned heat exchanger.

The water volume m is calculated according to the following formula:

$$m=\rho*V1=\rho*L*W*H*n*2*h1*k1,$$

where L is a length of a radiator heatsink, W is a width of the radiator heatsink, H is a height of the radiator heatsink, n is a quantity of the radiator heatsink, h1 is a thickness of the water film, k1 is a margin constant, and ρ is a density of water.

Herein, a value of k1 may be 1.2; and h1 is, for example, 200 nm.

The air volume q of the detected point of the fan is calculated according to the following formula:

$$q=k3*N+C,$$

where K3 and C are constant parameters of designs of different models and air outlets, and N is a corresponding fan speed of the to-be-cleaned heat exchanger.

K3 and C are constant parameters of designs of different models and air outlets at the fan side corresponding to the to-be-cleaned heat exchanger.

Preferably, a surface of the indoor heat exchanger is coated with a hydrophilic coating layer, thereby facilitating a water film to be formed at the surface of the indoor heat exchanger, and making sure that the water film evenly covers at the surface of the heat exchanger.

According to the method for cleaning an air conditioner indoor unit and outdoor unit of the present invention, after the keeping the to-be-cleaned heat exchanger frosting for a time of t1, and before the detecting whether a differential pressure between the high pressure and the low pressure of the air conditioner meets a preset condition, the method for cleaning an air conditioner indoor unit and outdoor unit further includes: stopping operation of the compressor; and keeping the corresponding fan of the to-be-cleaned heat exchanger to operate, so as to perform a defrosting processing.

Stopping the operation of the compressor before controlling the four-way valve to change the direction may enable the surface frosts of the heat exchangers to be melted into water quickly, and enable the differential pressure between the high pressure and the low pressure of the air conditioner to quickly reach a differential pressure of the preset condition.

According to the method for cleaning an air conditioner indoor unit and outdoor unit of the present invention, after the keeping the to-be-cleaned heat exchanger frosting for a time of t1, and before the detecting whether a differential pressure between the high pressure and the low pressure of the air conditioner meets a preset condition, the method for cleaning an air conditioner indoor unit and outdoor unit further includes: stopping operation of the compressor; and controlling the corresponding fan of the to-be-cleaned heat exchanger to stop operating, and after maintaining for a time of t4, starting the corresponding fan of the to-be-cleaned heat exchanger to operate, so as to enter the defrosting processing. Herein, t4 is, for example, 5 min.

Stopping the operation of the compressor, and then controlling the corresponding fan of the to-be-cleaned heat exchanger to stop operating and maintaining for a time may enable the surface frosts of the heat exchangers to be melted into water more completely.

Figure 2:
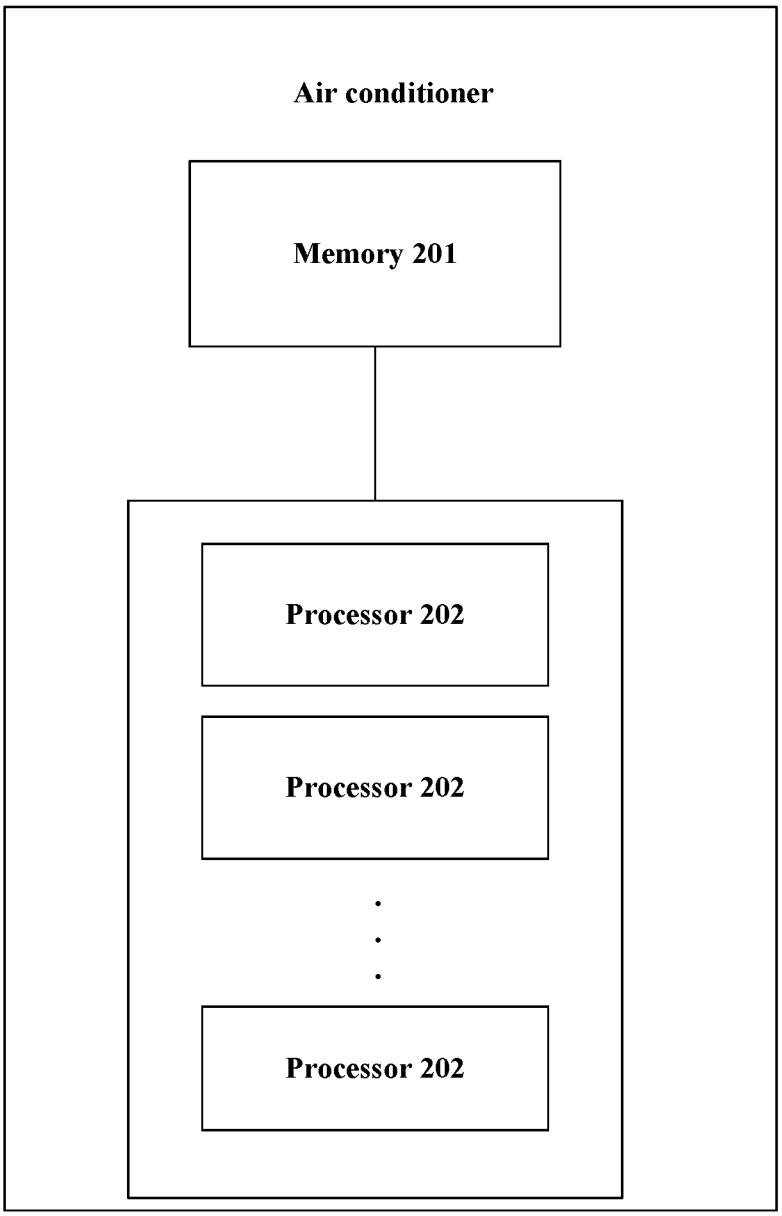
FIG. 2 is a structural illustration of an air conditioner according to an embodiment of the present invention.
Figure 3:
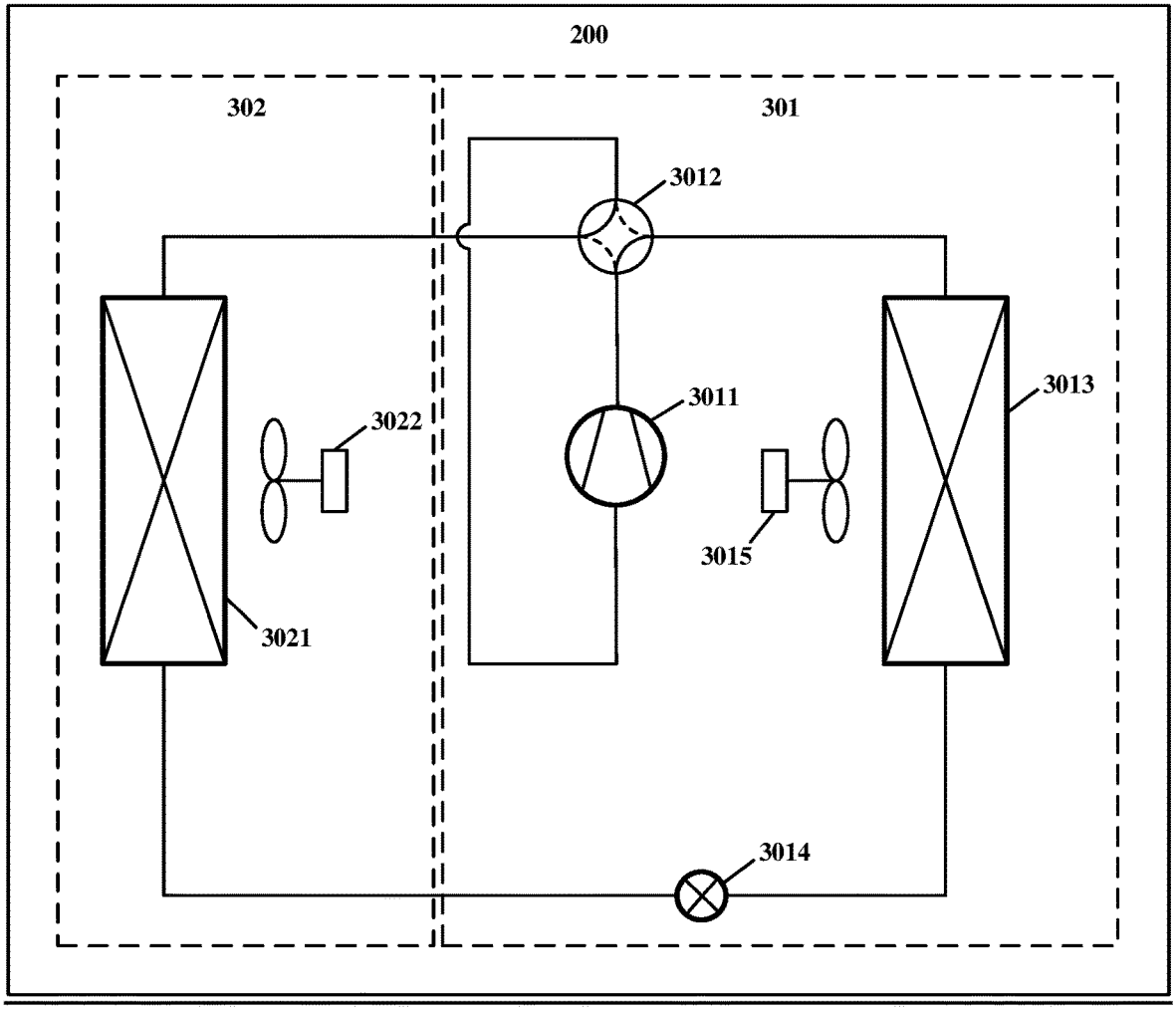
FIG. 3 is a structural illustration of the air conditioner in FIG. 2.

With reference to FIG. 2 and FIG. 3, according to the embodiments of the present invention, an air conditioner 200 comprises a memory 201, and one or more processors 202, wherein the memory 201 stores therein computer readable program codes, and the one or more processors 202 are configured to execute the computer readable program codes: to control a to-be-cleaned heat exchanger to enter a self-cleaning mode; to adjust an operating frequency of an air conditioner 200, an opening of a throttling device 3014, and a corresponding fan speed of the to-be-cleaned heat exchanger, and to maintain an evaporating temperature of the to-be-cleaned heat exchanger within a present range, so as to enable a surface of the to-be-cleaned heat exchanger to frost; to keep the to-be-cleaned heat exchanger frosting for a time of t1; to detect whether a differential pressure between a high pressure and a low pressure of the air conditioner 200 meets a preset condition; when the differential pressure between the high pressure and the low pressure of the air conditioner 200 meets the preset condition, to control a four-way valve 3012 to change a direction, so as to perform a defrosting switching to indoor and outdoor heat exchangers 3021 and 3013; and when the differential pressure between the high pressure and the low pressure of the air conditioner 200 does not meet the preset condition, to adjust an operating parameter of the air conditioner 200 to enable the differential pressure between the high pressure and the low pressure of the air conditioner 200 to meet the preset condition, and then to control the four-way valve 3012 to change the direction, so as to perform a defrosting switching to the indoor and outdoor heat exchangers 3021 and 3013.

According to another aspect of the present invention, a method for cleaning an air conditioner indoor unit 302 and outdoor unit 301 is provided, including:

Controlling, by a processor of an air conditioner 200, a to-be-cleaned heat exchanger of the air conditioner 200 to enter a self-cleaning mode; adjusting, by the processor, an operating frequency of an air conditioner 200, an opening of a throttling device 3014, and a corresponding fan speed of the to-be-cleaned heat exchanger, and maintaining, by the processor, an evaporating temperature of the to-be-cleaned heat exchanger within a present range, so as to enable a surface of the to-be-cleaned heat exchanger to frost; keeping, by the processor, the to-be-cleaned heat exchanger frosting for a time of t1; detecting, by the processor, whether a differential pressure between a high pressure and a low pressure of the air conditioner 200 meets a preset condition; when the differential pressure between the high pressure and the low pressure of the air conditioner 200 meets the preset condition, controlling, by the processor, a four-way valve 3012 to change a direction, so as to perform a defrosting switching to indoor and outdoor heat exchangers 3021 and 3013; and when the differential pressure between the high pressure and the low pressure of the air conditioner 200 does not meet the preset condition, adjusting, by the processor, an operating parameter of the air conditioner 200 to enable the differential pressure between the high pressure and the low pressure of the air conditioner 200 to meet the preset condition, and then controlling, by the processor, the four-way valve 3012 to change the direction, so as to perform a defrosting switching to the indoor and outdoor heat exchangers 3021 and 3013.

Preferably, when the following conditions are satisfied, the differential pressure between the high pressure and the low pressure of the air conditioner 200 is determined to meet the preset condition:

$|Ti-To|\leq B$, where a value of $B$ is 20-40; or $Pi/Po\leq A(Pi>Po)$; or $Po/Pi\leq A$(when $Po>Pi$), where Ti is the evaporating temperature, To is a condensing temperature, Pi is a corresponding saturated evaporating pressure of Ti, Po is a corresponding saturated condensing pressure of To, and a value of A is between 1.1-3.

Preferably, when the differential pressure between the high pressure and the low pressure of the air conditioner 200 does not meet the preset condition, the step of the adjusting an operating parameter of the air conditioner 200 to enable the differential pressure between the high pressure and the low pressure of the air conditioner 200 to meet the preset condition includes at least one of the following:

lifting speeds of indoor and outdoor fans 3022 and 3015, and increasing indoor and outdoor air volumes;

decreasing a frequency of a compressor 3011 to H1, and keeping for a time of t2; and adjusting the opening of the throttling device 3014 to the maximum.

Preferably, when performing self cleaning to the air conditioner 200, if the air conditioner 200 is in an operating mode of cooling or dehumidifying before the self cleaning is started, self cleaning to the indoor heat exchanger 3021 is first performed; and if the air conditioner 200 is in an operating mode of heating before the self cleaning is started, self cleaning to the outdoor heat exchanger 3013 is first performed.

Preferably, the step of the enabling a surface of the to-be-cleaned heat exchanger to frost includes: after the to-be-cleaned heat exchanger enters a frosting mode, controlling a corresponding fan of the to-be-cleaned heat exchanger to be started for a time of t3, so as to enable the surface of the to-be-cleaned heat exchanger to be covered with a water film; and then turning off the fan.

Preferably, a starting time of the fan is calculated according to the following formula:

$$t=\frac{Q}{k2*m}$$

where Q is a latent cooling quantity of the to-be-cleaned heat exchanger at a starting stage of the corresponding fan, k2 is latent heat of vaporization at an air outlet temperature, and m is a water volume for the to-be-cleaned heat exchanger to be covered with the water film.

Preferably, the latent cooling quantity Q is calculated according to the following formula:

$$Q=k2*q*(W1-W2)/V(1+W3)$$

where q is an air volume of a detected point of the corresponding fan of the to-be-cleaned heat exchanger, W1 is an air inlet absolute humidity, W2 is an air outlet absolute humidity, W3 is an air outlet relative humidity, V is a specific volume of humid air at the air outlet.

Preferably, the water volume m is calculated according to the following formula:

$$m=\rho*V1=\rho*L*W*H*n*2*h1*k1$$

where L is a length of a radiator heatsink, W is a width of the radiator heatsink, H is a height of the radiator heatsink, n is a quantity of the radiator heatsink, h1 is a thickness of the water film, k1 is a margin constant, and ρ is a density of water.

Preferably, the air volume q of the detected point of the fan is calculated according to the following formula:

$$q=k3*N+C,$$

where K3 and C are constant parameters of designs of different models and air outlets, and N is a corresponding fan speed of the to-be-cleaned heat exchanger.

Preferably, after the keeping the to-be-cleaned heat exchanger frosting for a time of t1, and before the detecting whether a differential pressure between a high pressure and a low pressure of the air conditioner meets a preset condition, the method for cleaning an air conditioner indoor unit and outdoor unit further includes: stopping operation of the compressor; and keeping the corresponding fan of the to-be-cleaned heat exchanger to operate, so as to perform a defrosting processing.

Preferably, after the keeping the to-be-cleaned heat exchanger frosting for a time of t1, and before the detecting whether a differential pressure between a high pressure and a low pressure of the air conditioner 200 meets a preset condition, the method for cleaning an air conditioner indoor unit 302 and outdoor unit 301 further includes: stopping operation of the compressor 3011; and controlling the corresponding fan of the to-be-cleaned heat exchanger to stop operating, and after maintaining for a time of t4, starting the corresponding fan of the to-be-cleaned heat exchanger to operate, so as to enter the defrosting processing.

It should be understood that the throttling device 3014 is not limited to being provided in the air conditioner outdoor unit 301 shown in FIG. 3, for example, it may also be provided in the air conditioner indoor unit 302, or it may be provided in both the air conditioner indoor unit 302 and the air conditioner outdoor unit 301.

It should be understood that the present invention is not limited to the flow and structures described above and shown in the accompanying drawing, and various modifications and variations may be made thereto. The scope of the present invention is only defined by the appended claims.

What is claimed is:

1. A method for cleaning an air conditioner indoor unit and outdoor unit, the method comprising:

controlling, by a processor of an air conditioner, a to-be-cleaned heat exchanger to enter a self-cleaning mode, the to-be-cleaned heat exchanger being either an indoor heat exchanger of the air conditioner or an outdoor heat exchanger of the air conditioner;

adjusting an operating frequency of the air conditioner, an opening of a throttling device, and a corresponding fan speed of the to-be-cleaned heat exchanger, and maintaining an evaporating temperature of the to-be-cleaned heat exchanger within a present range, so as to enable a surface of the to-be-cleaned heat exchanger to frost;

keeping the to-be-cleaned heat exchanger frosting for a time of t1;

detecting whether a differential pressure between a high pressure and a low pressure of the air conditioner meets a preset condition;

when the differential pressure between the high pressure and the low pressure of the air conditioner meets the preset condition, controlling a four-way valve to change a direction, so as to perform a defrosting on the to-be-cleaned heat exchanger; and when the differential pressure between the high pressure and the low pressure of the air conditioner does not meet the preset condition, adjusting an operating parameter of the air conditioner to enable the differential pressure between the high pressure and the low pressure of the air conditioner to meet the preset condition, and then controlling the four-way valve to change the direction, so as to perform the defrosting on the to-be-cleaned heat exchanger.

2. The method for cleaning the air conditioner indoor unit and outdoor unit according to claim 1, wherein when the following conditions are satisfied, the differential pressure between the high pressure and the low pressure of the air conditioner is determined to meet the preset condition:

$|Ti-To|\leq B$, where a value of $B$ is 20-40; or $Pi/Po\leq A(Pi>Po)$; or $Po/Pi\leq A$(when $Po>Pi$), wherein Ti is the evaporating temperature, To is a condensing temperature, Pi is a corresponding saturated evaporating pressure of Ti, Po is a corresponding saturated condensing pressure of To, and a value of A is between 1.1-3.

3. The method for cleaning the air conditioner indoor unit and outdoor unit according to claim 1, wherein, when the differential pressure between the high pressure and the low pressure of the air conditioner does not meet the preset condition, adjusting the operating parameter of the air conditioner to enable the differential pressure between the high pressure and the low pressure of the air conditioner to meet the preset condition comprises at least one of the following:

lifting speeds of indoor and outdoor fans, and increasing indoor and outdoor air volumes;

decreasing a frequency of a compressor to H1, and keeping for a time of t2, the frequency of the compressor being the operating frequency of the air conditioner; and adjusting the opening of the throttling device to the maximum.

4. The method for cleaning the air conditioner indoor unit and outdoor unit according to claim 1, wherein, when the air conditioner is in an operating mode of cooling or dehumidifying before the self-cleaning mode the indoor heat exchanger is the to-be-cleaned heat exchanger; and when the air conditioner is in an operating mode of heating before the self-cleaning mode, the outdoor heat exchanger is the to-be-cleaned heat exchanger.

5. The method for cleaning the air conditioner indoor unit and outdoor unit according to claim 1, wherein enabling the surface of the to-be-cleaned heat exchanger to frost comprises: after the to-be-cleaned heat exchanger enters a frosting mode, controlling a corresponding fan of the to-be-cleaned heat exchanger to be started for a time of t3, so as to enable the surface of the to-be-cleaned heat exchanger to be covered with a water film; and then turning off the fan.

6. The method for cleaning the air conditioner indoor unit and outdoor unit according to claim 5, wherein a starting time of the fan is calculated according to the following formula:

$$t=Q/(k2*m)$$

wherein Q is a latent cooling quantity of the to-be-cleaned heat exchanger at a starting stage of the corresponding fan, k2 is latent heat of vaporization at an air outlet temperature, and m is a water volume for the to-be-cleaned heat exchanger to be covered with the water film.

7. The method for cleaning the air conditioner indoor unit and outdoor unit according to claim 6, wherein the latent cooling quantity Q is calculated according to the following formula:

$$Q=k2*q*(W1-W2)/V(1+W3)$$

wherein q is an air volume of a detected point of the corresponding fan of the to-be-cleaned heat exchanger, W1 is an air inlet absolute humidity, W2 is an air outlet absolute humidity, W3 is an air outlet relative humidity, V is a specific volume of humid air at the air outlet.

8. The method for cleaning the air conditioner indoor unit and outdoor unit according to claim 6, wherein the water volume m is calculated according to the following formula:

$$m=\rho*V1=\rho*L*W*H*n*2*h1*k1$$

wherein L is a length of a radiator heatsink, W is a width of the radiator heatsink, H is a height of the radiator heatsink, n is a quantity of the radiator heatsink, h1 is a thickness of the water film, k1 is a margin constant, and ρ is a density of water.

9. The method for cleaning the air conditioner indoor unit and outdoor unit according to claim 1, wherein after the keeping the to-be-cleaned heat exchanger frosting for a time of t1, and before the detecting whether a differential pressure between a high pressure and a low pressure of the air conditioner meets the preset condition, the method for cleaning the air conditioner indoor unit and outdoor unit further comprises:

stopping operation of a compressor; and keeping the corresponding fan of the to-be-cleaned heat exchanger to operate, so as to perform a defrosting processing.

10. The method for cleaning the air conditioner indoor unit and outdoor unit according to claim 1, wherein after the keeping the to-be-cleaned heat exchanger frosting for a time of t1, and before the detecting whether a differential pressure between a high pressure and a low pressure of the air conditioner meets the preset condition, the method for cleaning the air conditioner indoor unit and outdoor unit further comprises:

stopping operation of a compressor; and controlling the corresponding fan of the to-be-cleaned heat exchanger to stop operating, and after maintaining for a time of t4, starting the corresponding fan of the to-be-cleaned heat exchanger to operate, so as to enter a defrosting processing.

11. An air conditioner, comprising a memory, and one or more processors, wherein the memory stores therein computer readable program codes, and the one or more processors are configured to execute the computer readable program codes:

to control a to-be-cleaned heat exchanger to enter a self-cleaning mode, the to-be-cleaned heat exchanger being either an indoor heat exchanger of an air conditioner or an outdoor heat exchanger of the air conditioner;

to adjust an operating frequency of the air conditioner, an opening of a throttling device, and a corresponding fan speed of the to-be-cleaned heat exchanger, and to maintain an evaporating temperature of the to-be-cleaned heat exchanger within a present range, so as to enable a surface of the to-be-cleaned heat exchanger to frost;

to keep the to-be-cleaned heat exchanger frosting for a time of t1;

to detect whether a differential pressure between a high pressure and a low pressure of the air conditioner meets a preset condition;

when the differential pressure between the high pressure and the low pressure of the air conditioner meets the preset condition, to control a four-way valve to change a direction, so as to perform a defrosting on the to-be-cleaned heat exchanger; and when the differential pressure between the high pressure and the low pressure of the air conditioner does not meet the preset condition, to adjust an operating parameter of the air conditioner to enable the differential pressure between the high pressure and the low pressure of the air conditioner to meet the preset condition, and then to control the four-way valve to change the direction, so as to perform the defrosting on the to-be-cleaned heat exchanger.

12. A method for cleaning an air conditioner indoor unit and outdoor unit, the method comprising:

controlling, by a processor of an air conditioner, a to-be-cleaned heat exchanger of the air conditioner to enter a self-cleaning mode, the to-be-cleaned heat exchanger being either an indoor heat exchanger of the air conditioner or an outdoor heat exchanger of the air conditioner;

adjusting, by the processor, an operating frequency of the air conditioner, an opening of a throttling device, and a corresponding fan speed of the to-be-cleaned heat exchanger, and maintaining, by the processor, an evaporating temperature of the to-be-cleaned heat exchanger within a present range, so as to enable a surface of the to-be-cleaned heat exchanger to frost;

keeping, by the processor, the to-be-cleaned heat exchanger frosting for a time of t1;

detecting, by the processor, whether a differential pressure between a high pressure and a low pressure of the air conditioner meets a preset condition;

when the differential pressure between the high pressure and the low pressure of the air conditioner meets the preset condition, controlling, by the processor, a four-way valve to change a direction, so as to perform the defrosting on the to-be-cleaned heat exchanger; and when the differential pressure between the high pressure and the low pressure of the air conditioner does not meet the preset condition, adjusting, by the processor, an operating parameter of the air conditioner to enable the differential pressure between the high pressure and the low pressure of the air conditioner to meet the preset condition, and then controlling, by the processor, the four-way valve to change the direction, so as to perform the defrosting on the to-be-cleaned heat exchanger.

* * * * *